United States Patent [19]

Buzil

[11] 4,304,547

[45] Dec. 8, 1981

[54] CANDLE HAVING REMOVABLE TABS FOR REVEALING MESSAGES

[75] Inventor: Ronald D. Buzil, Chicago, Ill.

[73] Assignee: Buzil Corporation, Chicago, Ill.

[21] Appl. No.: 918,479

[22] Filed: Jun. 23, 1978

[51] Int. Cl.[3] ..... F23Q 2/32

[52] U.S. Cl. ..... 431/126; 431/291; D26/7

[58] Field of Search ..... 431/288, 253, 290, 291, 431/292, 125, 126; 206/460; D73/1 R; 362/161, 163

[56] References Cited

U.S. PATENT DOCUMENTS

| | | | |
|---|---|---|---|
| 275,293 | 4/1883 | Tisdale | 431/126 |
| 1,576,205 | 3/1926 | Mertens | 431/288 X |
| 1,660,760 | 2/1928 | Murphy | 431/126 X |
| 3,039,283 | 6/1962 | Buscemi | 431/291 X |
| 3,286,492 | 11/1966 | Frazier, Jr. | 431/126 X |
| 3,706,523 | 12/1972 | Kumm | 431/126 |

OTHER PUBLICATIONS

*House and Garden,* p. 32, Nov. 1960.

*Primary Examiner*—Samuel Scott
*Assistant Examiner*—Randall L. Green
*Attorney, Agent, or Firm*—Jerome Goldberg

[57] ABSTRACT

A candle having a plurality of tabs securely positioned with a heat sensitive adhesive on the outside of the candle at various levels therealong. When the candle is burning at the level where the tab is located, the tab becomes detachable and may be pulled away from the candle for revealing a message previously hidden by the tab.

5 Claims, 9 Drawing Figures

CANDLE HAVING REMOVABLE TABS FOR REVEALING MESSAGES

BACKGROUND OF THE INVENTION

This invention relates generally to candles comprising a container with wax therein. More specifically, the invention relates to candles including a container with wax therein and having hidden messages spaced along the length thereof, which may be revealed as the wax is consumed.

In the past, candles were constructed having messages formed in the container for the wax. These messages were hidden by the wax, but as the wax at the rear of the message was consumed, the message became visible. With this type candle a special container having the desired messages formed therein, is required. Such special container is substantially more expensive than the cost of a container for a commonly used candle. Moreover, the messages were not always completely hidden, and with some effort the message could be deciphered.

The subject invention utilizes a conventional container for candles. A sheet having a plurality of tabs extending along the length thereof is secured to the container. Messages are hidden by the tabs. The tabs may be removed from the sheet to reveal the messages, when the candle is burning at the level where a corresponding tab is located.

It is, therefore, a primary object of the subject invention to provide a candle having a plurality of hidden messages, which may be revealed at different intervals of time during the burning of the candle.

Another object is to provide a candle having a plurality of tabs which are detachable when the heat generated by the candle has reached a predetermined intensity.

Another object is to provide a candle having tabs which are detachable when the temperature has reached approximately 125 degrees Fahrenheit.

BRIEF DESCRIPTION OF THE DRAWING

Referring now to the drawing, in which the same characters of reference are employed to indicate corresponding similar parts throughout the several figures of the drawing.

DESCRIPTION OF THE PREFERRED EMBODIMENT

Figure 1:
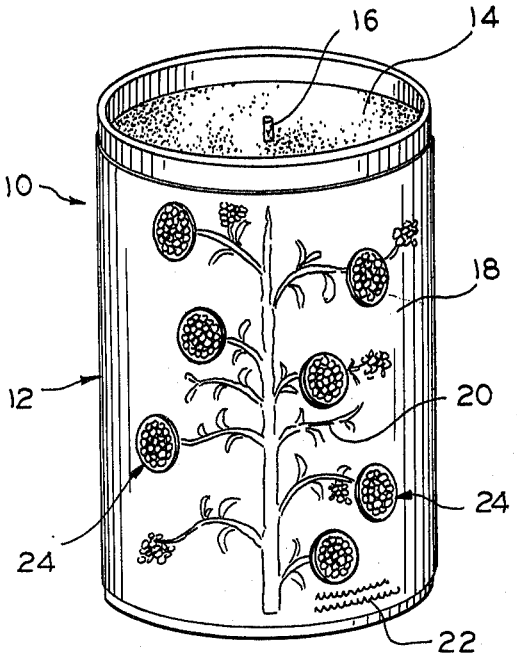
FIG. 1 is a perspective view of the candle embodying the principles of the invention.

Referring now to FIG. 1 of the drawing, the reference numeral 10 indicates generally a candle comprising a glass container 12 holding wax 14 therein. A wick 16 is embedded in the wax 14 and extends out therefrom.

A sheet 18 is secured to the outside of the container 12. The sheet 18 includes a pictorial illustration 20 and written information 22. A plurality of tabs or patches 24 are secured spaced apart at various levels on the illustration 20. The inside surface 26 of the tab 24 includes written indicia 28. Alternatively, such written indicia 28 may be imprinted on the sheet 18 and the corresponding tab 24 covers the indicia 28.

When the wax 14 has melted at the level where one of the tabs 24 is located and has generated sufficient heat, an edge 29 may be lifted outward and the tab 24 may be pulled completely away from the sheet 18. The indicia 28 on the inside surface 26 is now revealed. Such indicia may be, for example, a saying of "wisdom" or a prophecy of a personal future event. As the wax 14 is further consumed, the other lower levels of wax become heated, and the corresponding tabs 24 may be similarly removed for reading the inscription on the inside surface 26 thereof.

An adhesive 30 is placed at preselected locations on the outside 31 of the sheet 18. The tabs 24 are positioned on these locations and pressed into place when the adhesive is in a viscous and liquid state, to be secured thereon when the adhesive dries.

The adhesive 30 must melt from the heat generated at the level where the wax 14 is melting and being consumed. Generally, the heat at this level of candle burning is in the range of 125 to 130 degrees Fahrenheit. Therefore, a preferred adhesive 30 should melt at about 125 degrees Fahrenheit. Such an adhesive is commercially available and is often referred to as a "hot melt" glue.

The adhesive 30 is a solid at room temperature. A heat plate 34 may be used to sufficiently melt the adhesive and to apply a pressure against the tabs 24 so that the liquid adhesive 30 is spread evenly on the surface for securing the tabs to the sheet 18 as the adhesive dries after the heat plate is removed.

Alternatively, the adhesive 30 may be a solid initially, having a cylindrical shape to function as a cartridge, which is insertible into a conventional electrical glue gun. The cartridge is heated in the gun, and the adhesive is ejected therefrom as a viscous liquid.

Figure 2:
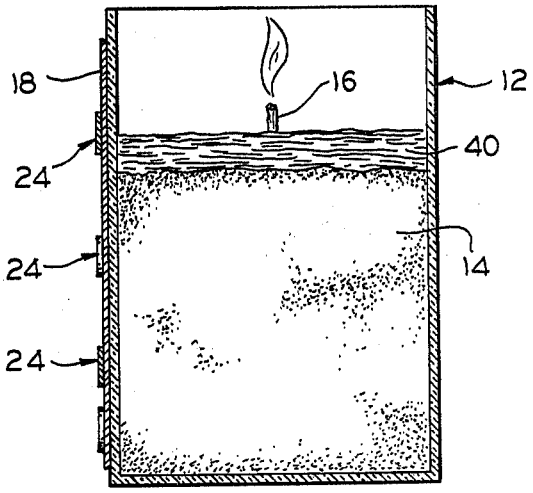
FIG. 2 is a sectional view of the candle, showing the heat generating area for enabling the removal of the tabs.
Figure 3:
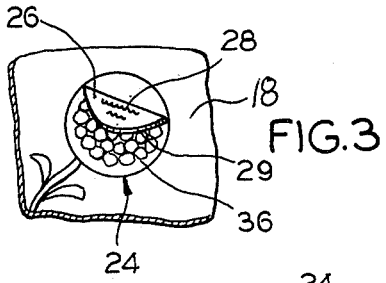
FIG. 3 illustrates the tab being pulled away from the sheet, to reveal a message on the inside surface thereof.
Figure 4A:
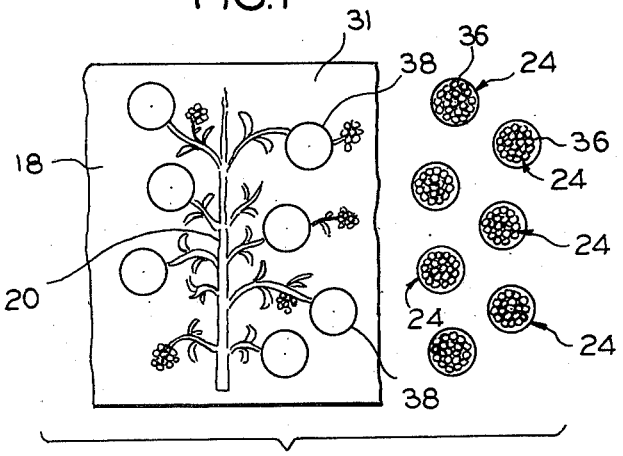
FIG. 4A illustrates the sheet and the tabs prior to being secured thereon.
Figure 5:
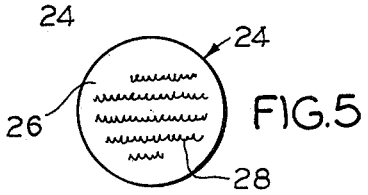
FIG. 5 illustrates the message on the back of the tab
Figure 4B:
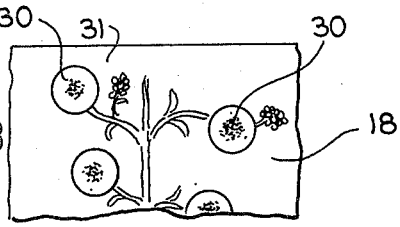
FIG. 4B illustrates the adhesive substance positioned on the ring of the sheets.
Figure 4C:
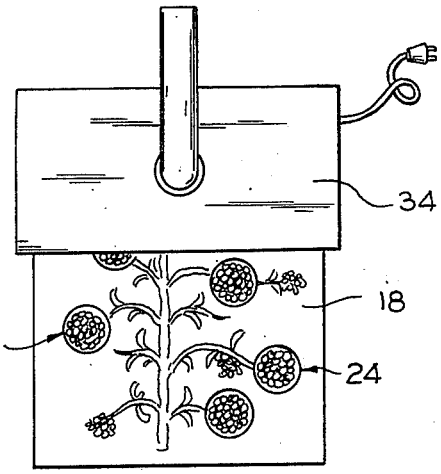
FIG. 4C illustrates the heat plate for heat pressing the tabs on to sheet.

In the embodiment depicted in the drawing, the pictorial illustration 20 is a berry tree having clusters of berries shown thereon. Each tab 24 has an outside surface 36 with a cluster of berries imprinted thereon. The sheet 18 also includes rings 38 spaced apart at different levels along the tree. Each ring 38 is covered by the tab 24 to provide removable berry clusters having messages 28 on the inside surface 26 thereof. As shown in FIG. 2, when the upper level 40 of wax has melted, the tab 24 at such level 40, may be lifted away from the sheet 18, to expose the message.

Figure 6:
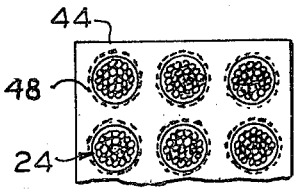
FIG. 6 illustrates a sheet of tabs which are removable along the scored lines.
Figure 7:
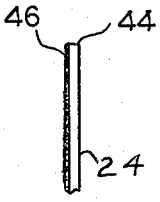
FIG. 7 is a side view of the sheet of tabs in FIG. 6, to illustrate the layer of adhesive on the back side thereof.

In FIGS. 6 and 7, an alternative embodiment is illustrated, which includes a sheet of tabs 44 having a layer of adhesive 46 on the back side thereof. The adhesive 46 may be formed by spraying the adhesive in a liquid state on the back of the sheet of tabs 44. The individual tabs 24 are severed from the sheet when needed. Grooved or scored lines 48 may be formed in the sheet 44 to facilitate the removal of the tabs 24. The heat plate 34 would be required for securing the tabs to the sheet 18.

The tab 24 is only removable when the heat of the wax 14 or the heat from the flame is sufficient to melt the adhesive 30. Thus, the tab 24 at the level where the wax 14 is melting or the tab 24 immediately above the melting wax, if not previously removed, is removable, but the tabs 24 below the melting area of the wax 14 would not be removable.

The description of the preferred embodiment of this invention is intended merely as illustrative of this invention, the scope and limits of which are set forth in the following claims.

I claim:

1. A method for revealing a message hidden on a candle comprising a container with wax therein, said method including the steps of:

positioning a tab at a specific vertical level on said container for covering said message;

securing said tab at said level with an adhesive, for preventing the removal of the tab at room temperature;

consuming and melting said wax to said level for generating sufficient heat to melt the adhesive; and removing said tab from the container when said adhesive has melted, for revealing said message.

2. The method of claim 1 includes:

positioning said tab on a sheet of material;

securing the tab on the sheet with said adhesive;

securing the sheet on the container; and removing the tab from the sheet when said adhesive has melted, for revealing said message.

3. The method of claim 1 includes:

placing said message on the back of said tab.

4. The method of claim 1 includes:

forming a plurality of said tabs on a sheet of material;

applying said adhesive in a liquid state to the back of the tabs; and removing said tab from said sheet of tabs after the adhesive has dried.

5. The method of claim 4 includes:

positioning said tab on a second sheet of material;

heating said tab for melting said adhesive; and cooling said tab for solidifying said adhesive to provide a secure bond of said tab with said second sheet of material.

* * * * *